US012269669B2

(12) United States Patent
Wang et al.

(10) Patent No.: US 12,269,669 B2
(45) **Date of Patent: *Apr. 8, 2025**

(54) CUSHION PACKAGE BOX AND ELECTRONIC PRODUCT CUSHION PACKAGE ASSEMBLY

(71) Applicant: Wistron Corporation, New Taipei (TW)

(72) Inventors: Kuo-Shen Wang, New Taipei (TW); Shixiong Wen, New Taipei (TW)

(73) Assignee: Wistron Corporation, New Taipei (TW)

( * ) Notice: Subject to any disclaimer, the term of this patent is extended or adjusted under 35 U.S.C. 154(b) by 49 days.

This patent is subject to a terminal disclaimer.

(21) Appl. No.: 18/224,039

(22) Filed: Jul. 19, 2023

(65) Prior Publication Data

US 2023/0356921 A1 Nov. 9, 2023

Related U.S. Application Data

(63) Continuation-in-part of application No. 17/857,153, filed on Jul. 4, 2022, now Pat. No. 11,738,930.

(30) Foreign Application Priority Data

Aug. 24, 2021 (CN) ..... 202122009485.9

(51) Int. Cl.

| | |
|---|---|
| ***B65D 85/30*** | (2006.01) |
| ***B65D 81/107*** | (2006.01) |
| ***B65D 81/127*** | (2006.01) |

(52) U.S. Cl.

CPC ..... *B65D 85/30* (2013.01); *B65D 81/107* (2013.01); *B65D 81/127* (2013.01); *B65D 2581/053* (2013.01)

(58) Field of Classification Search

CPC .... B65D 81/133; B65D 81/107; B65D 85/68; B65D 2581/053; B65D 2585/86; B65D 85/30; B65D 81/127

USPC ..... 206/591, 594

See application file for complete search history.

(56) References Cited

U.S. PATENT DOCUMENTS

| | | | | |
|---|---|---|---|---|
| 4,836,379 | A * | 6/1989 | Shaw | B65D 81/107 206/453 |
| 5,462,171 | A * | 10/1995 | Moog | B65D 81/113 428/116 |
| 7,871,363 | B1 * | 1/2011 | Branyon | B65D 5/5047 493/287 |
| 11,738,930 | B2 * | 8/2023 | Wang | B65D 5/5045 206/522 |
| 2008/0128317 | A1 * | 6/2008 | Tsukada | B65D 81/107 206/594 |
| 2013/0277418 | A1 * | 10/2013 | Van Berlo | B65D 81/02 229/87.02 |

(Continued)

*Primary Examiner* — Jacob K Ackun

(74) *Attorney, Agent, or Firm* — Winston Hsu

(57) ABSTRACT

A cushion package box includes a box body, a first cushion member and a plurality of paper tubes. The first cushion member is disposed in the box body and the first cushion member has a porous structure. The plurality of paper tubes is disposed in the box body. At least one of the plurality of paper tubes is in contact with the first cushion member. An opening direction of the porous structure is different from an opening direction of the at least one paper tube.

20 Claims, 19 Drawing Sheets

(56) References Cited

U.S. PATENT DOCUMENTS

| | | | | |
|---|---|---|---|---|
| 2020/0216252 | A1* | 7/2020 | Laguna | F16M 13/022 |
| 2022/0250827 | A1* | 8/2022 | Smith | B65B 5/028 |

* cited by examiner

CUSHION PACKAGE BOX AND ELECTRONIC PRODUCT CUSHION PACKAGE ASSEMBLY

CROSS REFERENCE TO RELATED APPLICATIONS

This application is a continuation-in-part of U.S. application Ser. No. 17/857,153, filed on Jul. 4, 2022, and China Application No. 202122009485.9, filed on Aug. 24, 2021. The contents of the applications are incorporated herein by reference.

BACKGROUND OF THE INVENTION

1. Field of the Invention

The disclosure relates to a cushion package box and an electronic product cushion package assembly and, more particularly, to a cushion package box and an electronic product cushion package assembly capable of reducing assembly materials and improving assembly efficiency.

2. Description of the Prior Art

In general, a product will be packed in a package box when shipped to prevent the product from being damaged due to impact during transportation. In order to match the external dimensions of the product, the cushion components in the package box are designed by a multi-piece structure, thereby improving the protection ability of the cushion material to the product. For the product with large size and heavy weight, the compression coefficient should be calculated according to different sizes and different weights, such that the package design requires more cushion components to achieve the required compression coefficient during transportation. Since the structural design is complicated and too many cushion components needs to be assembled, the manual assembly operation is complicated, such that it is easy to cause problems such as improper assembly and lack of components. Furthermore, due to cost and environmental factors, the conventional cushion components are mostly made of molded pulp and/or corrugated paper. The recovery ability of molded pulp and corrugated paper after drop test is not good, the molded pulp is easily affected by environmental humidity, and the corrugated paper has many parts and complicated structure.

SUMMARY OF THE INVENTION

The disclosure provides a cushion package box and an electronic product cushion package assembly capable of reducing assembly materials and improving assembly efficiency, so as to solve the aforesaid problems.

According to an embodiment of the disclosure, a cushion package box comprises a box body, a first cushion member and a plurality of paper tubes. The first cushion member is disposed in the box body and the first cushion member has a porous structure. The plurality of paper tubes is disposed in the box body. At least one of the plurality of paper tubes is in contact with the first cushion member. An opening direction of the porous structure is different from an opening direction of the plurality of paper tubes.

According to another embodiment of the disclosure, an electronic product cushion package assembly comprises a cushion package box and an electronic product. The cushion package box comprises a box body, a first cushion member and a plurality of paper tubes. The first cushion member is disposed in the box body and the first cushion member has a porous structure. The plurality of paper tubes is disposed in the box body. At least one of the plurality of paper tubes is in contact with the first cushion member. An opening direction of the porous structure is different from an opening direction of the plurality of paper tubes. The electronic product is disposed in the box body. The at least one paper tube surrounds the electronic product.

As mentioned in the above, the disclosure replaces the molded pulp and/or the corrugated paper of the prior art by the first cushion member with the porous structure and the paper tube, so as to reduce assembly materials of the cushion package box, reduce assembly cost, and improve assembly efficiency. Since the structure of the cushion package box is simplified, the disclosure can effectively avoid the problems such as improper assembly and lack of components due to manual assembly operation. Furthermore, the cushion abilities of the first cushion member with the porous structure and the paper tube are good, such that the disclosure can effectively improve the protection to the product. Moreover, the material characteristics of the first cushion member with the porous structure and the paper tube may reduce the cushion distance, such that the whole volume of the cushion package box may be further reduced, so as to increase the packing capacity of the cushion package box and reduce the transportation cost. In practical applications, the cushion package box of the disclosure may be used to pack an object (e.g. electronic product) to form the electronic product cushion package assembly. In addition, the number and shape of the paper tubes and the size of the first cushion member may be determined according to the type of the object. Accordingly, the cushion package box may be more flexible in design and use.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
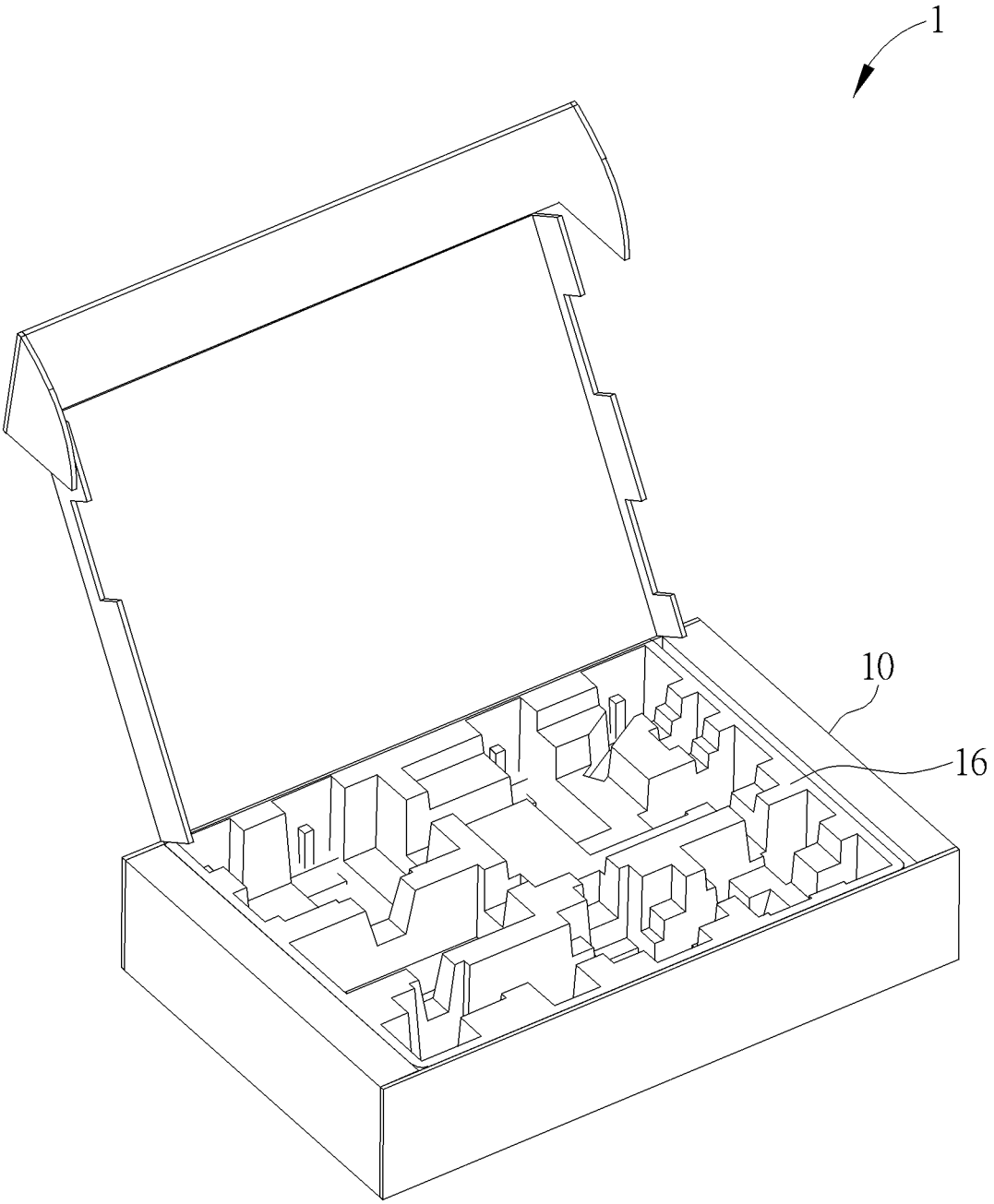
FIG. 1 is a perspective view illustrating a cushion package box according to an embodiment of the disclosure.
Figure 2:
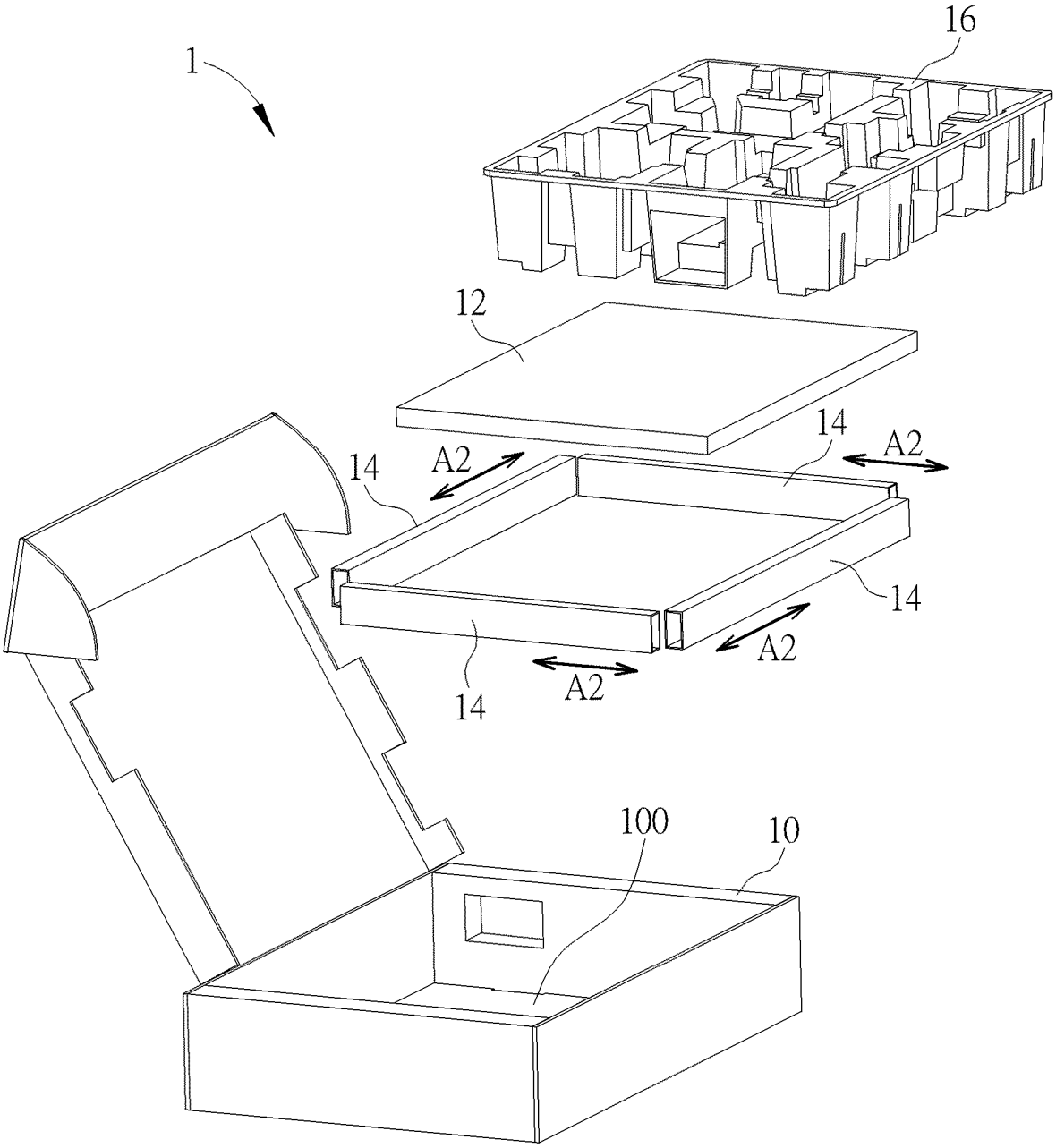
FIG. 2 is an exploded view illustrating the cushion package box shown in FIG. 1.
Figure 3:
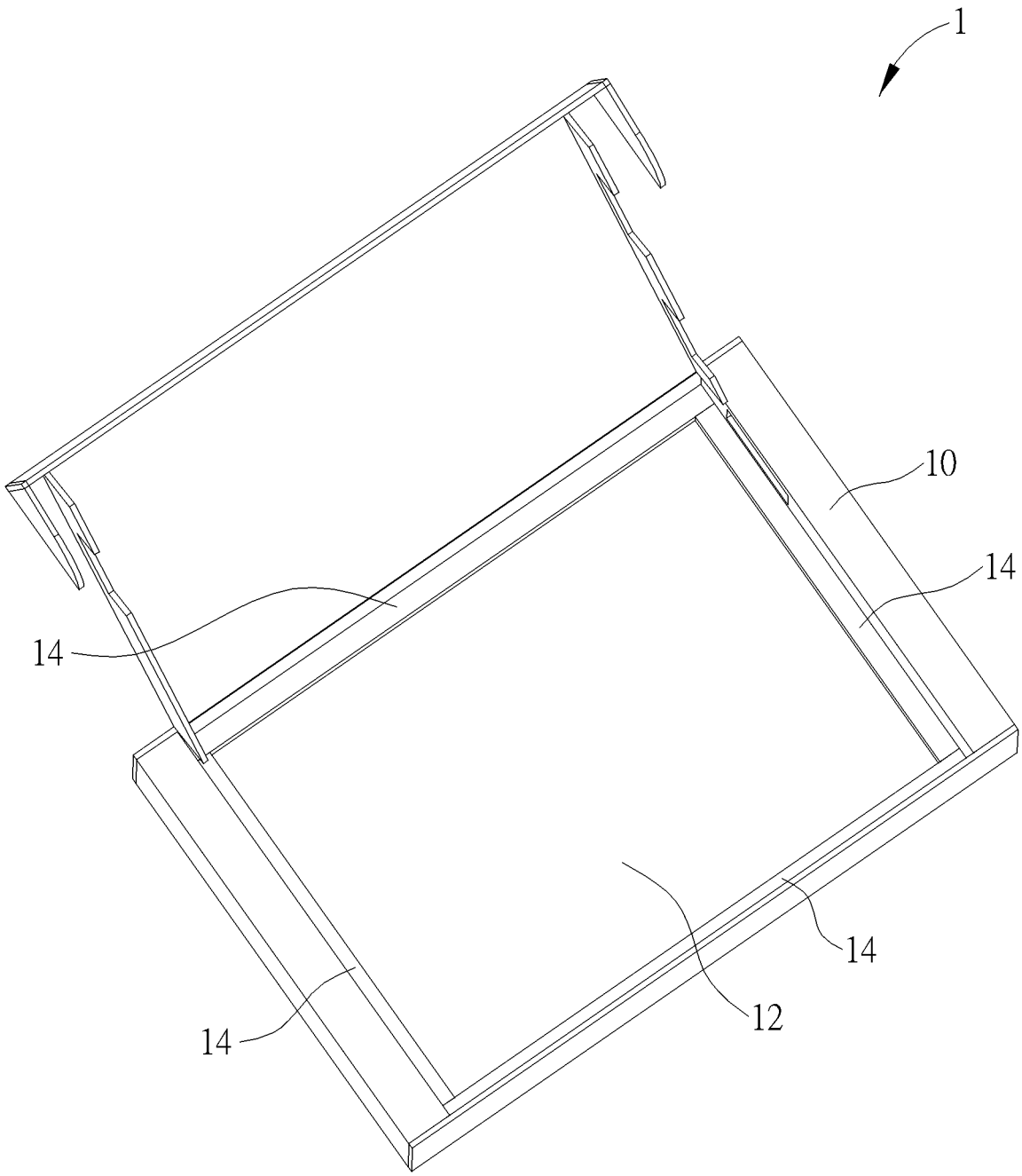
FIG. 3 is a perspective view illustrating the first cushion member and the paper tubes shown in FIG. 2 being disposed in the box body.
Figure 4:
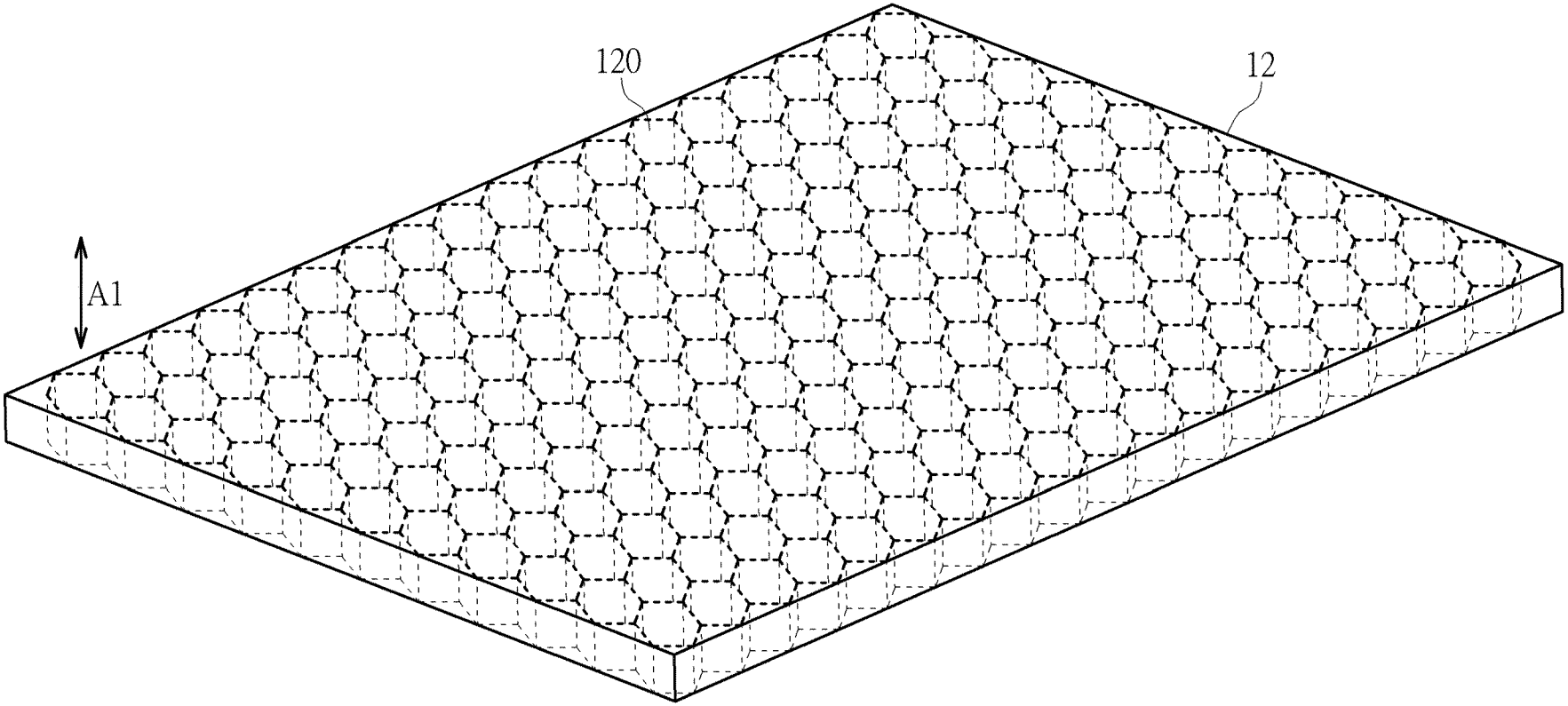
FIG. 4 is a perspective view illustrating the first cushion member shown in FIG. 2.

Referring to FIGS. 1 to 4, FIG. 1 is a perspective view illustrating a cushion package box 1 according to an embodiment of the disclosure, FIG. 2 is an exploded view illustrating the cushion package box 1 shown in FIG. 1, FIG. 3 is a perspective view illustrating the first cushion member 12 and the paper tubes 14 shown in FIG. 2 being disposed in the box body 10, and FIG. 4 is a perspective view illustrating the first cushion member 12 shown in FIG. 2.

As shown in FIGS. 1 to 4, the cushion package box 1 comprises a box body 10, a first cushion member 12, a plurality of paper tubes 14 and a second cushion member 16. In this embodiment, the number of the plurality of paper tubes 14 is four and the four paper tubes 14 are strip-shaped. The first cushion member 12, the paper tubes 14 and the second cushion member 16 are disposed in the box body 10, wherein each of the paper tubes 14 is in contact with the first cushion member 12. It should be noted that, in some embodiments, at least one of the paper tubes 14 may be in contact with the first cushion member 12 according to practical applications. When assembling the cushion package box 1, the first cushion member 12 and the four paper tubes 14 may be placed into the box body 10 first, such that the four paper tubes 14 are arranged to form a rectangle and surrounds the first cushion member 12, as shown in FIG. 3. Then, the second cushion member 16 is placed into the box body 10, such that the second cushion member 16 is located above the first cushion member 12. When the cushion package box 1 is used to pack an object (e.g. electronic product), the object is sandwiched in between the second cushion member 16, the first cushion member 12 and the paper tubes 14, and the paper tubes 14 surround the object to provide cushion protection for the object.

In another embodiment, the first cushion member 12 may be disposed on the bottom of the box body 10 first and then the paper tubes 14 are disposed on the first cushion member 12. Accordingly, the paper tubes 14 may selectively surround the first cushion member 12 or be disposed on the first cushion member 12 according to practical requirements.

As shown in FIG. 4, the first cushion member 12 has a porous structure 120. In this embodiment, the first cushion member 12 may be a honeycomb board, i.e. the porous structure 120 is honeycomb-shaped. For further explanation, the honeycomb board may comprise two paper plates and a plurality of paper tubes disposed between the two paper plates, wherein the openings of the paper tubes are perpendicular to the two paper plates.

Furthermore, an opening direction A1 of the porous structure 120 is different from an opening direction A2 of the paper tube 14. When the first cushion member 12 is disposed in the box body 10, the opening direction A1 of the porous structure 120 is perpendicular to a bottom surface 100 of the box body 10 (as shown in FIG. 2). It should be noted that the height of the porous structure 120 may be adjusted according to the object to be packed. As shown in FIG. 2, a cross section of a tube body of the paper tube 14 may be rectangular. In this embodiment, the paper tube 14 may be made of a spool paper. When the paper tube 14 is disposed in the box body 10, the opening direction A2 of the paper tube 14 is parallel to the bottom surface 100 of the box body 10. Thus, the opening direction A1 of the porous structure 120 of the first cushion member 12 is perpendicular to the opening direction A2 of the paper tube 14.

By means of the cooperation between the first cushion member 12 with the porous structure 120 and the paper tube 14, the disclosure can effectively increase the cushion effect and the compression coefficient for the object during transportation. The disclosure replaces the molded pulp and/or the corrugated paper of the prior art by the first cushion member 12 with the porous structure 120 and the paper tube 14, so as to reduce assembly materials of the cushion package box 1, reduce assembly cost, and improve assembly efficiency. Since the structure of the cushion package box 1 is simplified, the disclosure can effectively avoid the problems such as improper assembly and lack of components due to manual assembly operation.

In this embodiment, the second cushion member 16 may be a molded pulp pad, such that a lower surface of the second cushion member 16 may be formed into a corresponding shape (e.g. an arc or other regular/irregular shapes) according to the appearance of the object to be packaged, so as to better fit the object and further provide a better cushion effect.

Figure 5:
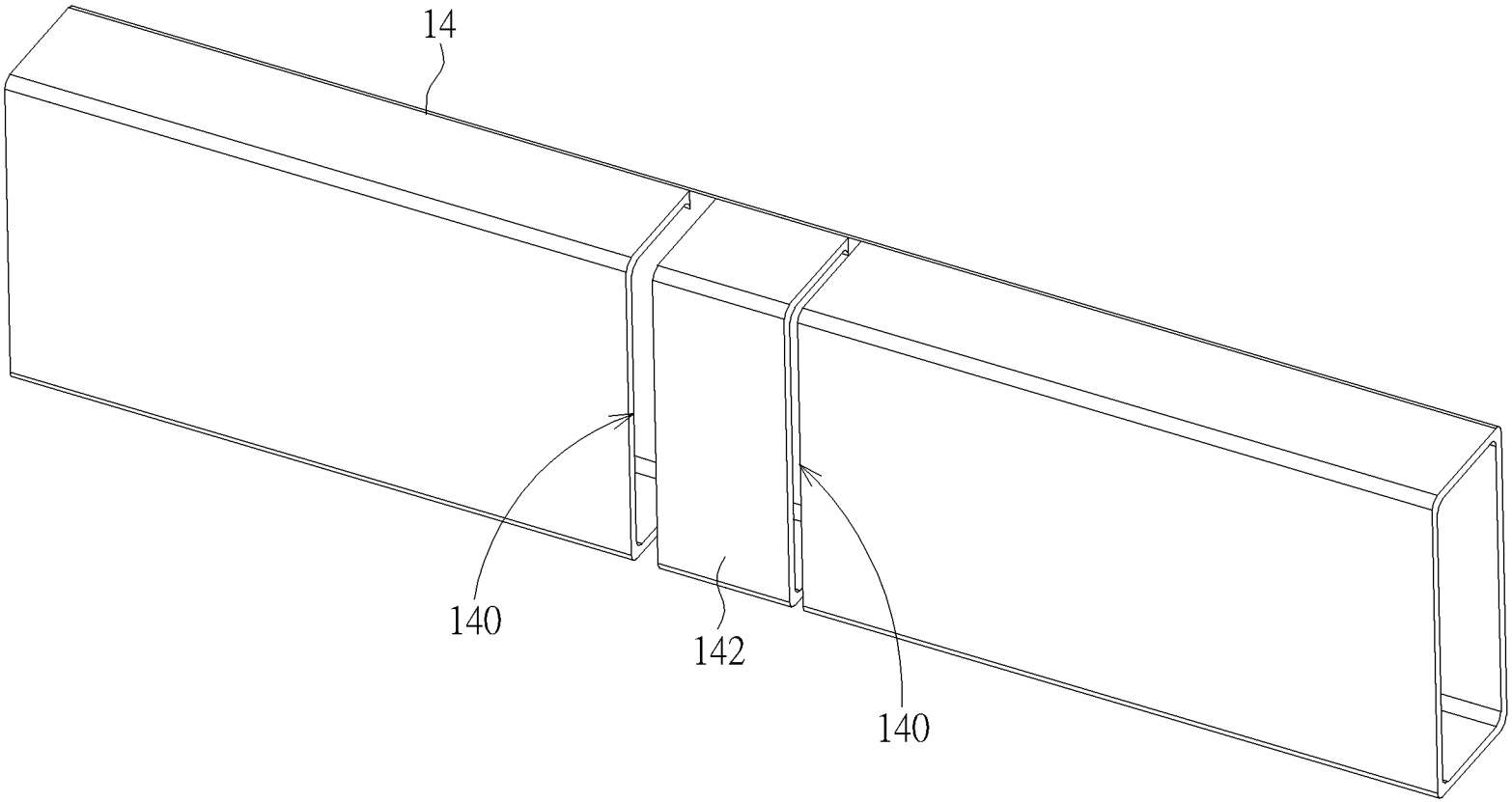
FIG. 5 is a perspective view illustrating a paper tube according to another embodiment of the disclosure.
Figure 6:
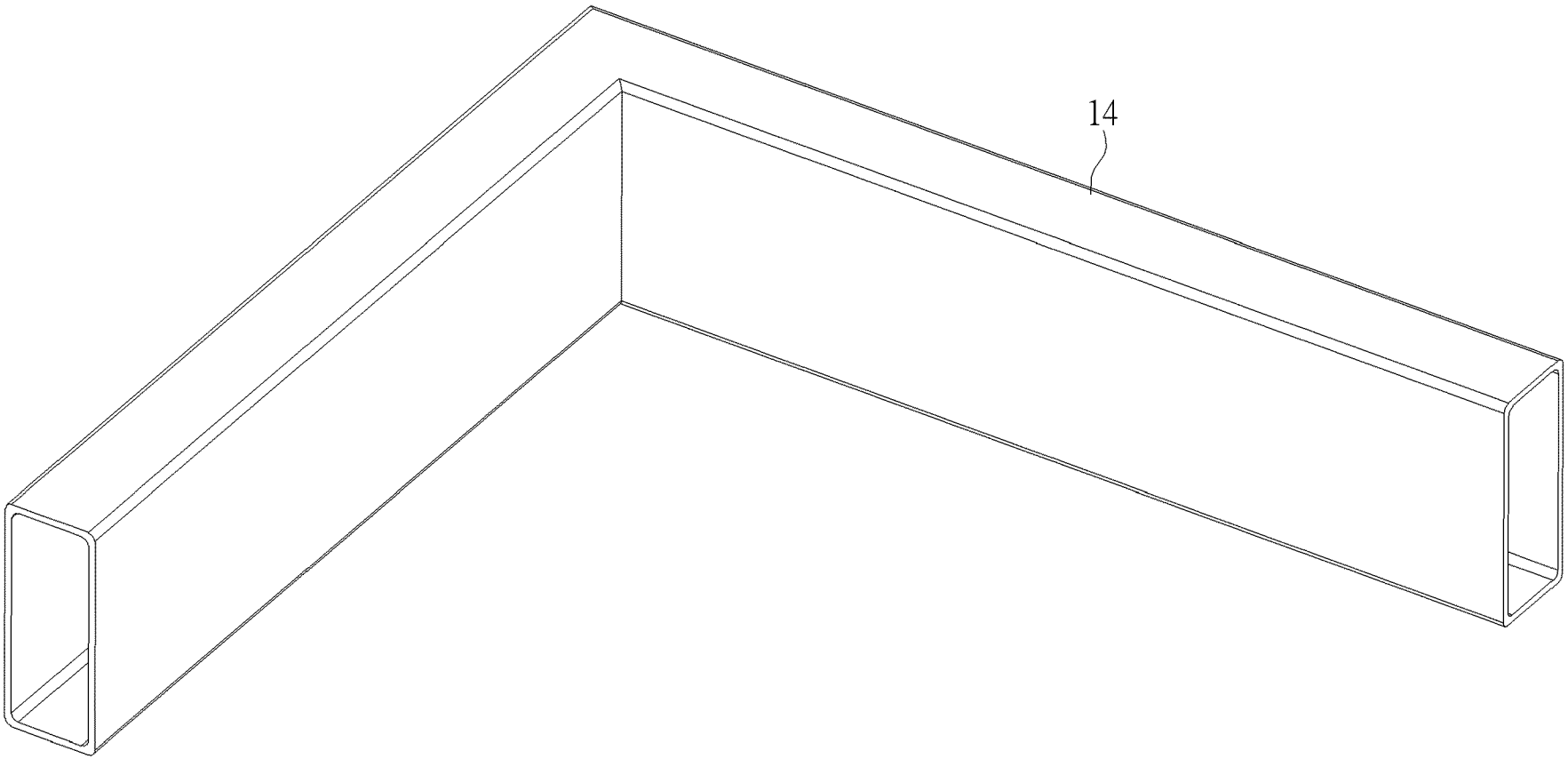
FIG. 6 is a perspective view illustrating the paper tube shown in FIG. 5 being bent to be L-shaped.

Referring to FIGS. 5 and 6, FIG. 5 is a perspective view illustrating a paper tube 14 according to another embodiment of the disclosure, and FIG. 6 is a perspective view illustrating the paper tube 14 shown in FIG. 5 being bent to be L-shaped.

As shown in FIG. 5, a tube body of the paper tube 14 has two cutting grooves 140 and a reinforcing portion 142, wherein the reinforcing portion 142 is located between the two cutting grooves 140. When the tube body of the paper tube 14 is bent to be L-shaped shown in FIG. 6, the reinforcing portion 142 is retracted into the tube body of the paper tube 14 from one of the two cutting grooves 140, such that the reinforcing portion 142 is located in the tube body of the paper tube 14, so as to reinforce the structural strength of the paper tube 14. Accordingly, the number of the paper tubes 14 of the disclosure may be two, i.e. the aforesaid cushion package box 1 may comprise two paper tubes 14 shown in FIG. 5, wherein the two paper tubes 14 are bent to be L-shaped, such that the two paper tubes 14 may be arranged to form a rectangle to surround the first cushion member 12 shown in FIG. 2 or be disposed on the first cushion member 12.

In another embodiment, one of two paper tubes may be bent to be U-shaped through the structure shown in FIG. 5, and the other one of the two paper tubes may be strip-shaped shown in FIG. 2, such that the two paper tubes may be arranged to form a rectangle to surround the first cushion member 12 shown in FIG. 2 or be disposed on the first cushion member 12.

In another embodiment, the number of the paper tubes 14 of the disclosure may be one and the paper tube 14 may be bent to form a rectangle through the structure shown in FIG. 5, so as to surround the first cushion member 12 shown in FIG. 2 or be disposed on the first cushion member 12. For further explanation, every two adjacent paper tubes 14 may be connected by the cutting groove 140 and the reinforcing portion 142 to form one single paper tune.

Figure 7:
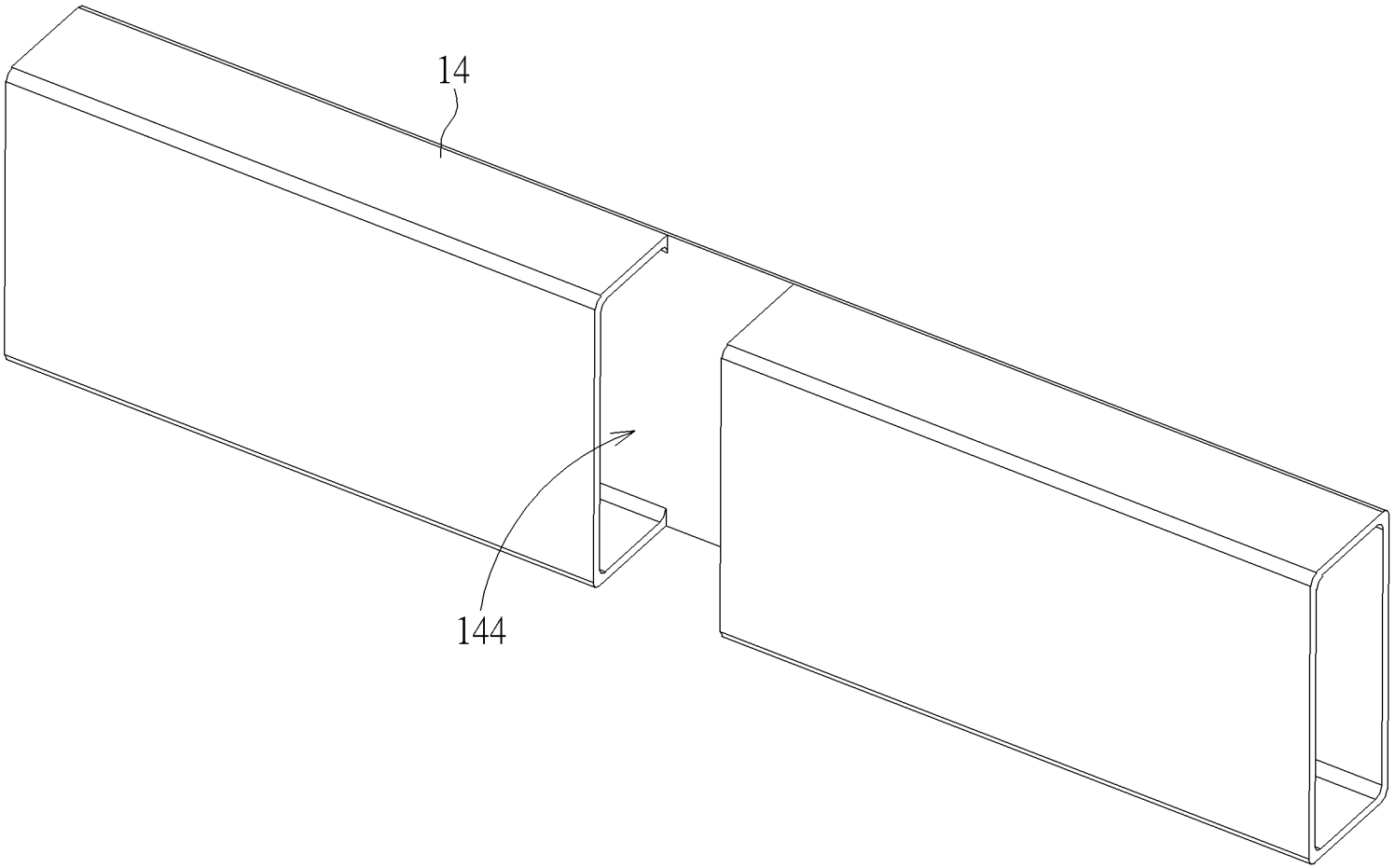
FIG. 7 is a perspective view illustrating a paper tube according to another embodiment of the disclosure.

Referring to FIG. 7, FIG. 7 is a perspective view illustrating a paper tube 14 according to another embodiment of the disclosure. As shown in FIG. 7, a tube body of the paper tube 14 has a slot 144, such that the tube body of the paper tube 14 is able to be bent along the slot 144 by 90 degrees to be L-shaped shown in FIG. 6. Needless to say, the tube body of the paper tube 14 may also have two or three slots 144, such that the tube body of the paper tube 14 is able to bent along the slots 144 to be U-shaped or rectangular.

Figure 8:
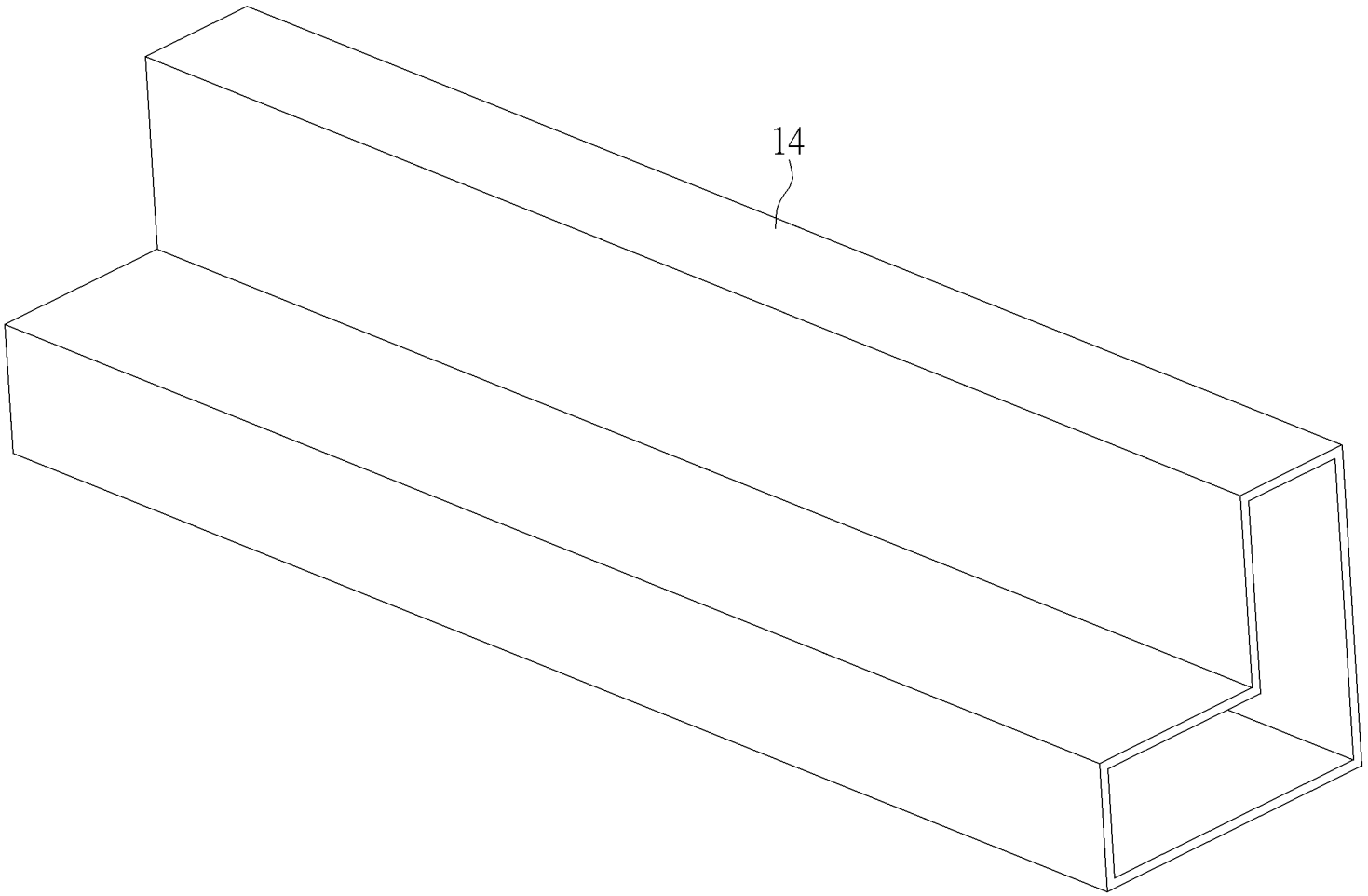
FIG. 8 is a perspective view illustrating a paper tube according to another embodiment of the disclosure.
Figure 9:
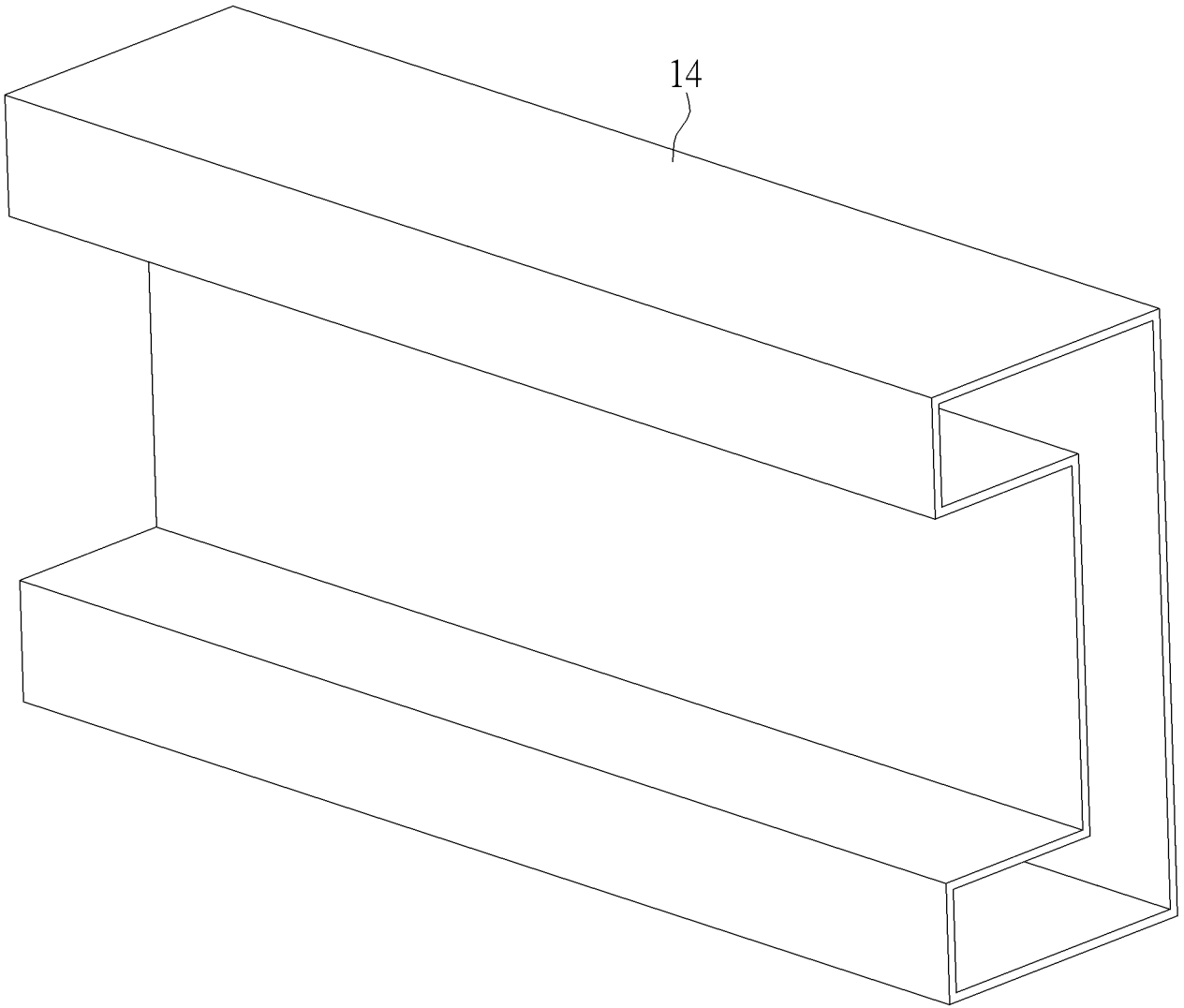
FIG. 9 is a perspective view illustrating a paper tube according to another embodiment of the disclosure.

Referring to FIGS. 8 and 9, FIG. 8 is a perspective view illustrating a paper tube 14 according to another embodiment of the disclosure, and FIG. 9 is a perspective view illustrating a paper tube 14 according to another embodiment of the disclosure. In addition to the rectangular cross section shown in FIG. 2, the cross section of the tube body of the paper tube 14 may also be L-shaped or U-shaped (as shown in FIGS. 8 and 9) to meet the package requirements of different objects.

Figure 10:
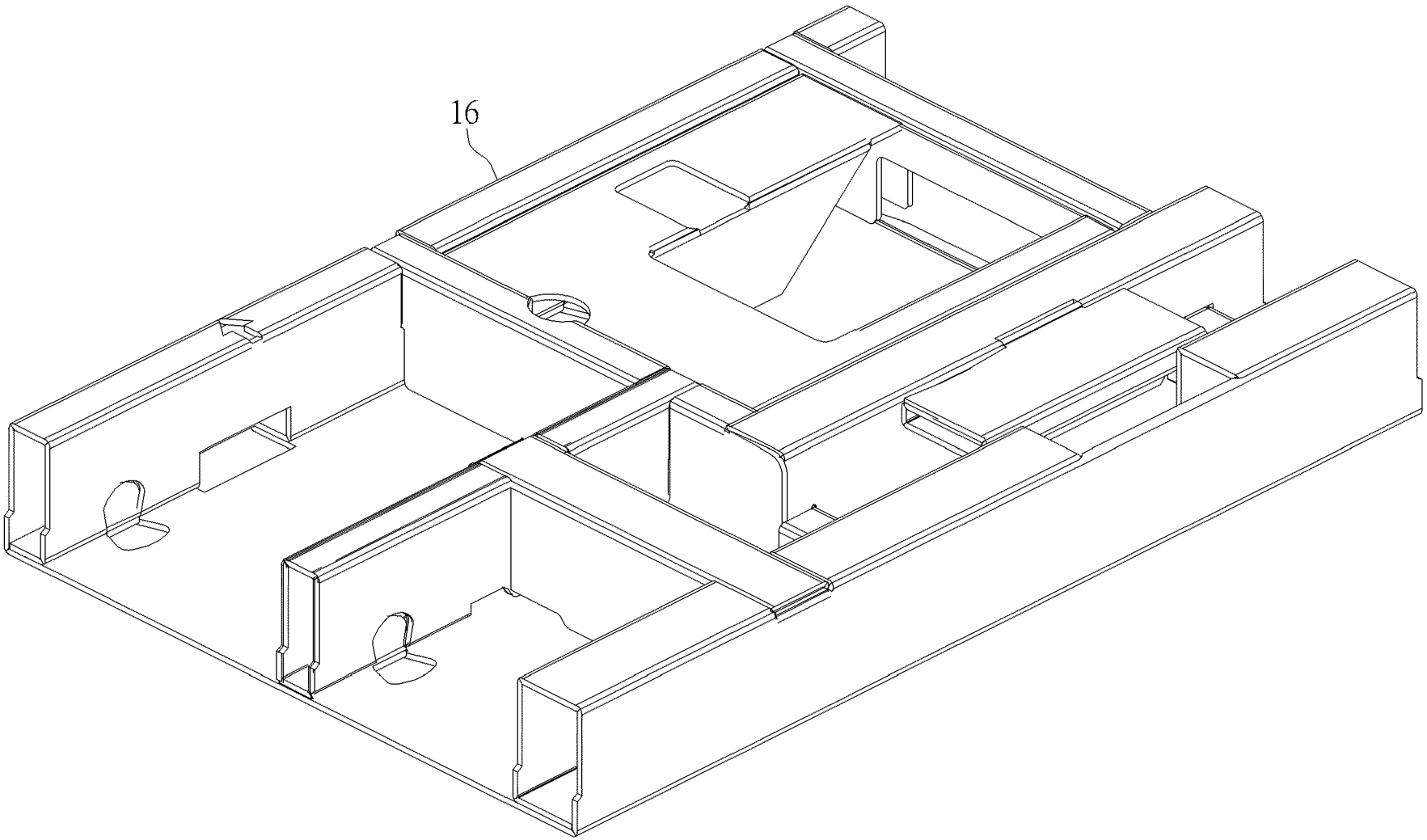
FIG. 10 is a perspective view illustrating a second cushion member according to another embodiment of the disclosure.

Referring to FIG. 10, FIG. 10 is a perspective view illustrating a second cushion member 16 according to another embodiment of the disclosure. In addition to the molded pulp pad shown in FIG. 2, the second cushion member 16 may also be a corrugated paper pad (as shown in FIG. 10) to meet the package requirements of different objects. Furthermore, the second cushion member 16 may also be a honeycomb board shown in FIG. 4 according to practical applications.

It should be noted that some objects do not need the second cushion member 16 to provide cushion effect when packing. At this time, the second cushion member 16 may be omitted from the aforesaid cushion package box 1, i.e. the aforesaid cushion package box 1 may only comprise the box body 10, the first cushion member 12 and the paper tube 14.

Figure 11:
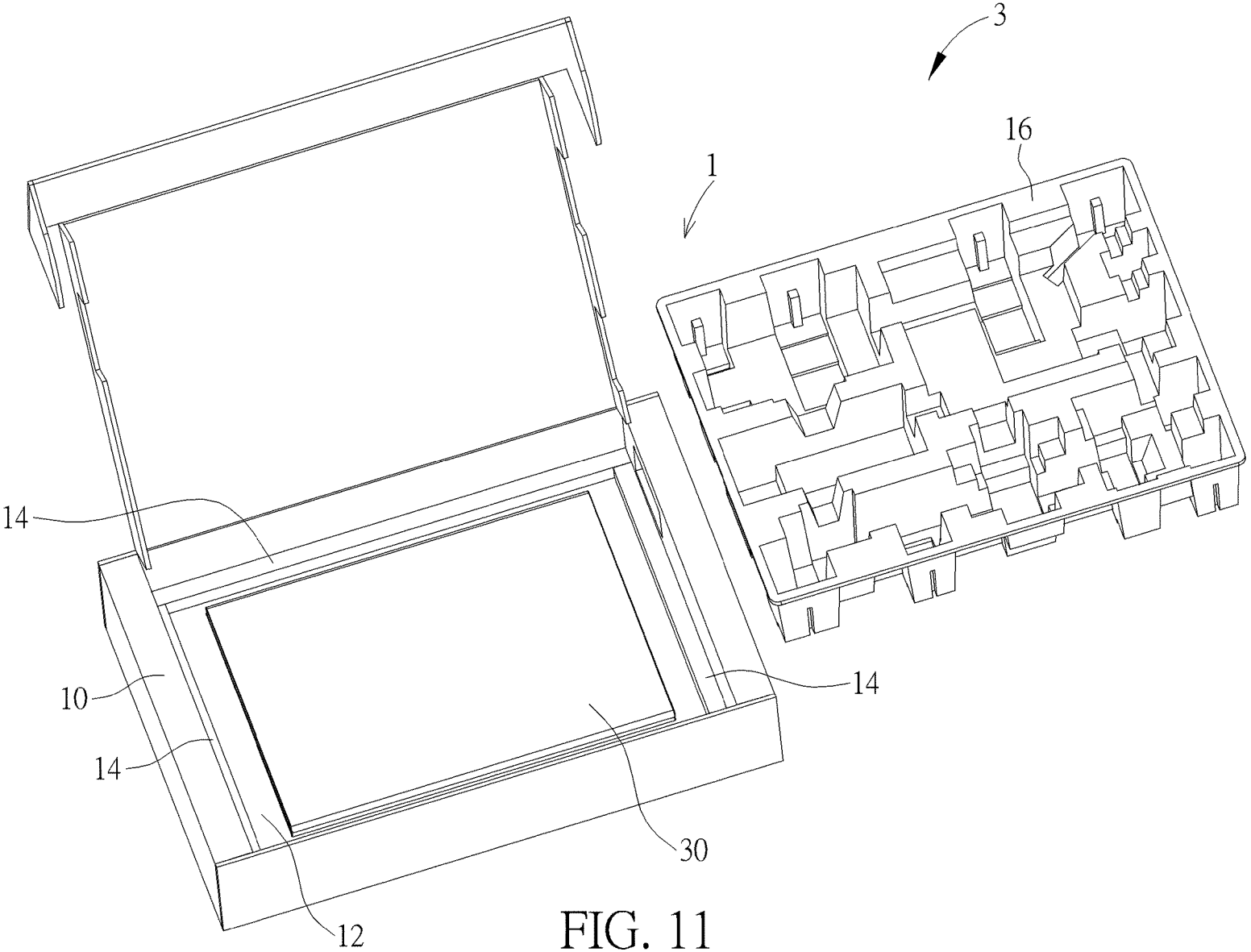
FIG. 11 is a perspective view illustrating an electronic product cushion package assembly according to an embodiment of the disclosure.

Referring to FIG. 11, FIG. 11 is a perspective view illustrating an electronic product cushion package assembly 3 according to an embodiment of the disclosure, wherein the second cushion member 16 is removed from the box body 10 to expose an electronic product 30. As shown in FIG. 11, the electronic product cushion package assembly 3 comprises the aforesaid cushion package box 1 and an electronic product 30. For further explanation, the object packed by the cushion package box 1 may be the electronic product 30 (e.g. display device, notebook computer, tablet computer, television, all-in-one device, and so on). When the object packed by the cushion package box 1 is the electronic product 30, the electronic product 30 is sandwiched in between the second cushion member 16, the first cushion member 12 and the paper tubes 14, and the paper tubes 14 surround the electronic product 30, so as to provide cushion protection for the electronic product 30.

Figure 12:
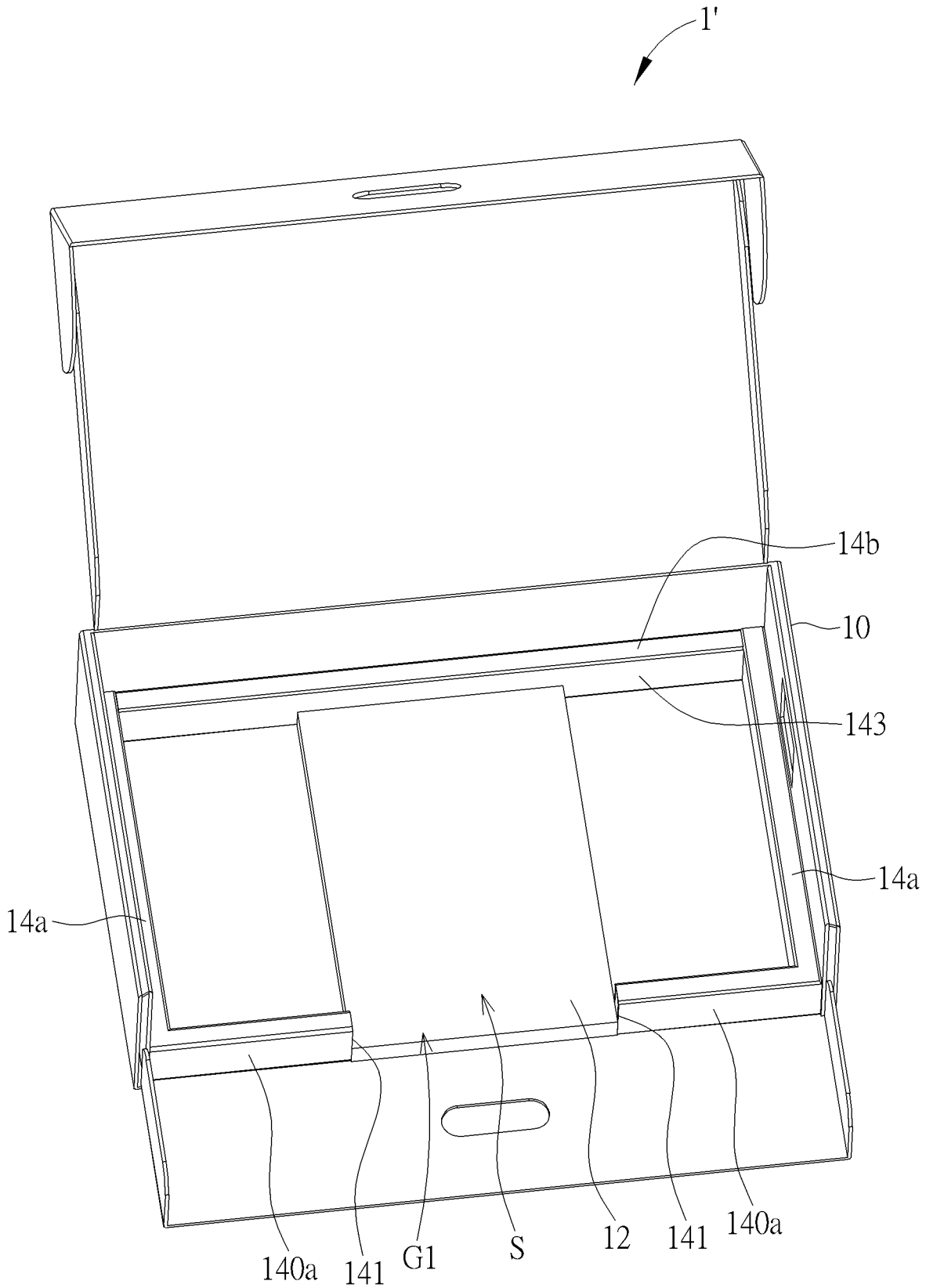
FIG. 12 is a perspective view illustrating a cushion package box according to another embodiment of the disclosure.

Referring to FIG. 12, FIG. 12 is a perspective view illustrating a cushion package box 1' according to another embodiment of the disclosure. As shown in FIG. 12, a number of the paper tubes is three, wherein one of the three paper tubes is strip-shaped and the other two of the three paper tubes are bent to be L-shaped. In other words, the paper tubes of the cushion package box 1' comprise two L-shaped paper tubes **14*a* and a strip-shaped paper tube 14*b*. Each of the two L-shaped paper tubes 14*a* may be formed by bending a strip-shaped paper tube along a slot (like the slot 144 shown in FIG. 7) by 90 degrees. The two L-shaped paper tubes 14*a* are disposed at opposite sides of the strip-shaped paper tube 14*b* and located at opposite sides of the box body 10, wherein opposite ends of the strip-shaped paper tube 14*b* respectively abut against the two L-shaped paper tubes 14*a*. A first gap G1 is formed between two sides 140*a* of the two L-shaped paper tubes 14*a* and opposite to the strip-shaped paper tube 14*b*. As shown in FIG. 12, an edge (e.g. lower edge) of the first cushion member 12 is located in the first gap G1 and sandwiched in between the two sides 140*a* of the two L-shaped paper tubes 14*a*, such that an end portion 141 of each of the two L-shaped paper tubes 14*a* is in contact with the first cushion member 12. Furthermore, another edge (e.g. upper edge) of the first cushion member 12 abuts against the strip-shaped paper tube 14*b*, such that a side portion 143 of the strip-shaped paper tube 14*b* is in contact with the first cushion member 12. Accordingly, the first cushion member 12 can be positioned in the box body 10 stably. In addition, the length of the first cushion member 12 shown in FIG. 12 may be reduced to 40%-50% of the length of the first cushion member 12 shown in FIG. 3. According to practical applications, the size (thickness and/or height) of different paper tubes may be different, so as to meet the requirements in use. For example, the L-shaped paper tube 14*a* shown in FIG. 12 is thicker and has a larger outer diameter, such that the L-shaped paper tube 14*a*** has a stronger shock resistance.

Furthermore, the two L-shaped paper tubes **14*a* and the strip-shaped paper tube 14*b* define an inner space S for accommodating the first cushion member 12**.

Figure 13:
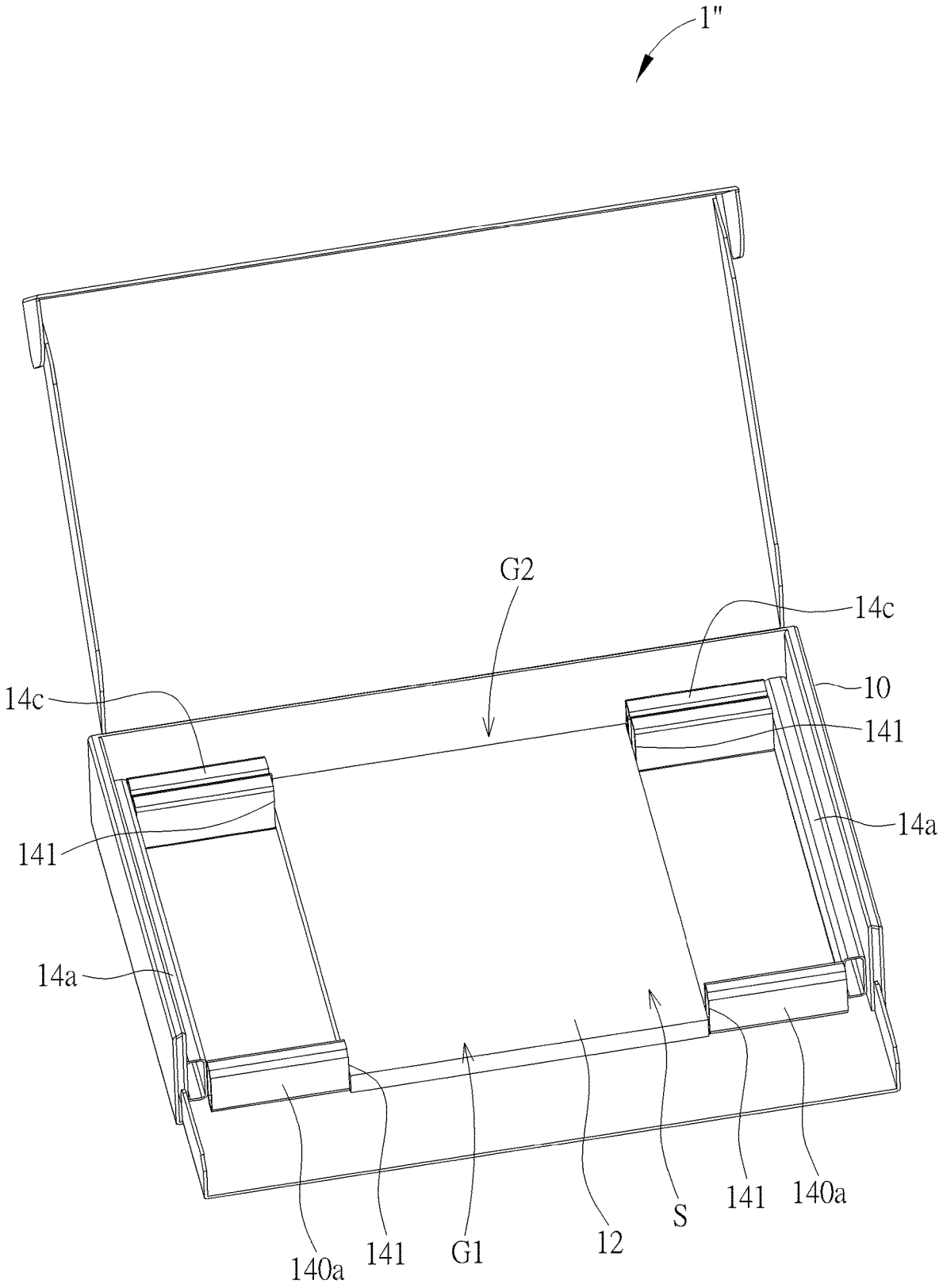
FIG. 13 is a perspective view illustrating a cushion package box according to another embodiment of the disclosure.

Referring to FIG. 13, FIG. 13 is a perspective view illustrating a cushion package box 1" according to another embodiment of the disclosure. As shown in FIG. 13, the paper tubes of the cushion package box 1" comprise two L-shaped paper tubes **14*a* and two double-stacked paper tubes 14*c*. Each of the two L-shaped paper tubes 14*a* may be formed by bending a strip-shaped paper tube along a slot (like the slot 144 shown in FIG. 7) by 90 degrees. For further explanation, the paper tube 14 shown in FIG. 7 may be bent along the slot 144 by 90 degrees toward a direction opposite to the slot 144, so as to form the L-shaped paper tube 14*a* shown in FIG. 13. Each of the two double-stacked paper tubes 14*c* may be formed by bending a strip-shaped paper tube along a slot (like the slot 144 shown in FIG. 7) by 180 degrees, so as to increase the strength of the paper tube. For further explanation, the paper tube 14 shown in FIG. 7 may be bent along the slot 144 by 180 degrees toward a direction opposite to the slot 144, so as to form the double-stacked paper tubes 14*c* shown in FIG. 13. The two L-shaped paper tubes 14*a* are located at opposite sides of the box body 10, and the two double-stacked paper tubes 14*c* respectively abut against the two L-shaped paper tubes 14*a*. A first gap G1 is formed between two sides 140*a* of the two L-shaped paper tubes 14*a* and a second gap G2 is formed between the two double-stacked paper tubes 14*c*. As shown in FIG. 13, an edge (e.g. lower edge) of the first cushion member 12 is located in the first gap G1 and sandwiched in between the two sides 140*a* of the two L-shaped paper tubes 14*a*, such that an end portion 141 of each of the two L-shaped paper tubes 14*a* is in contact with the first cushion member 12. Furthermore, another edge (e.g. upper edge) of the first cushion member 12 is located in the second gap G2** and sandwiched in between the two double-stacked paper tubes

14*c*, such that an end portion 141 of each of the two double-stacked paper tubes 14*c* is in contact with the first cushion member 12. Accordingly, the first cushion member 12 can be positioned in the box body 10 stably.

Furthermore, the two L-shaped paper tubes 14*a* and the two double-stacked paper tubes 14*c* define an inner space S for accommodating the first cushion member 12.

Figure 14:
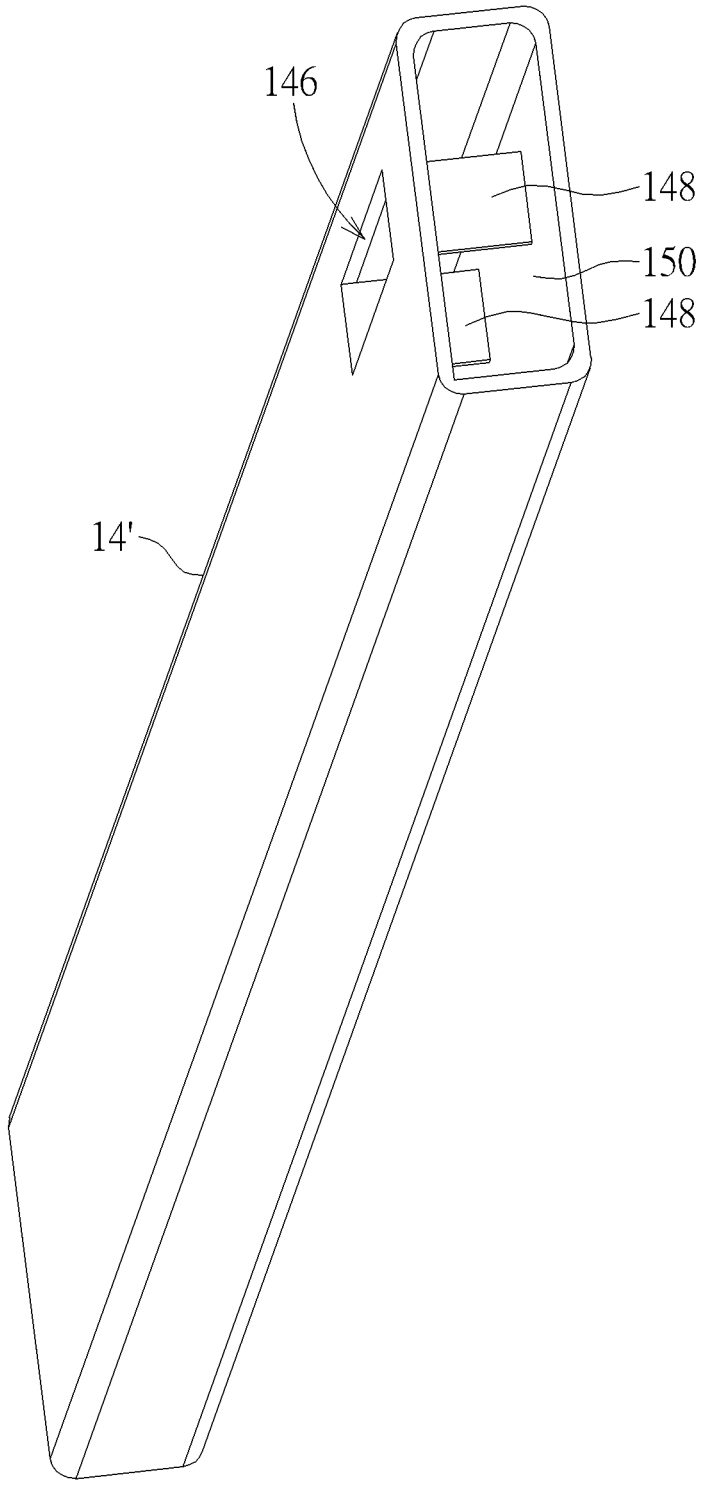
FIG. 14 is a perspective view illustrating a paper tube according to another embodiment of the disclosure.

Referring to FIG. 14, FIG. 14 is a perspective view illustrating a paper tube 14' according to another embodiment of the disclosure. As shown in FIG. 14, at least one reinforcing portion 148 may be bent from a side of the paper tube 14' to abut against an inner surface 150 of the paper tube 14' and form a through hole 146. In this embodiment, two reinforcing portions 148 are bent from a side of the paper tube 14' to abut against the inner surface 150 of the paper tube 14', but the disclosure is not so limited. When the paper tube 14' is disposed in the aforesaid box body 10, the through hole 146 may be used to accommodate a protruding structure (e.g. function key, etc.) of an electronic product. Furthermore, the reinforcing portion 148 increases the strength of the paper tube 14'.

Figure 15:
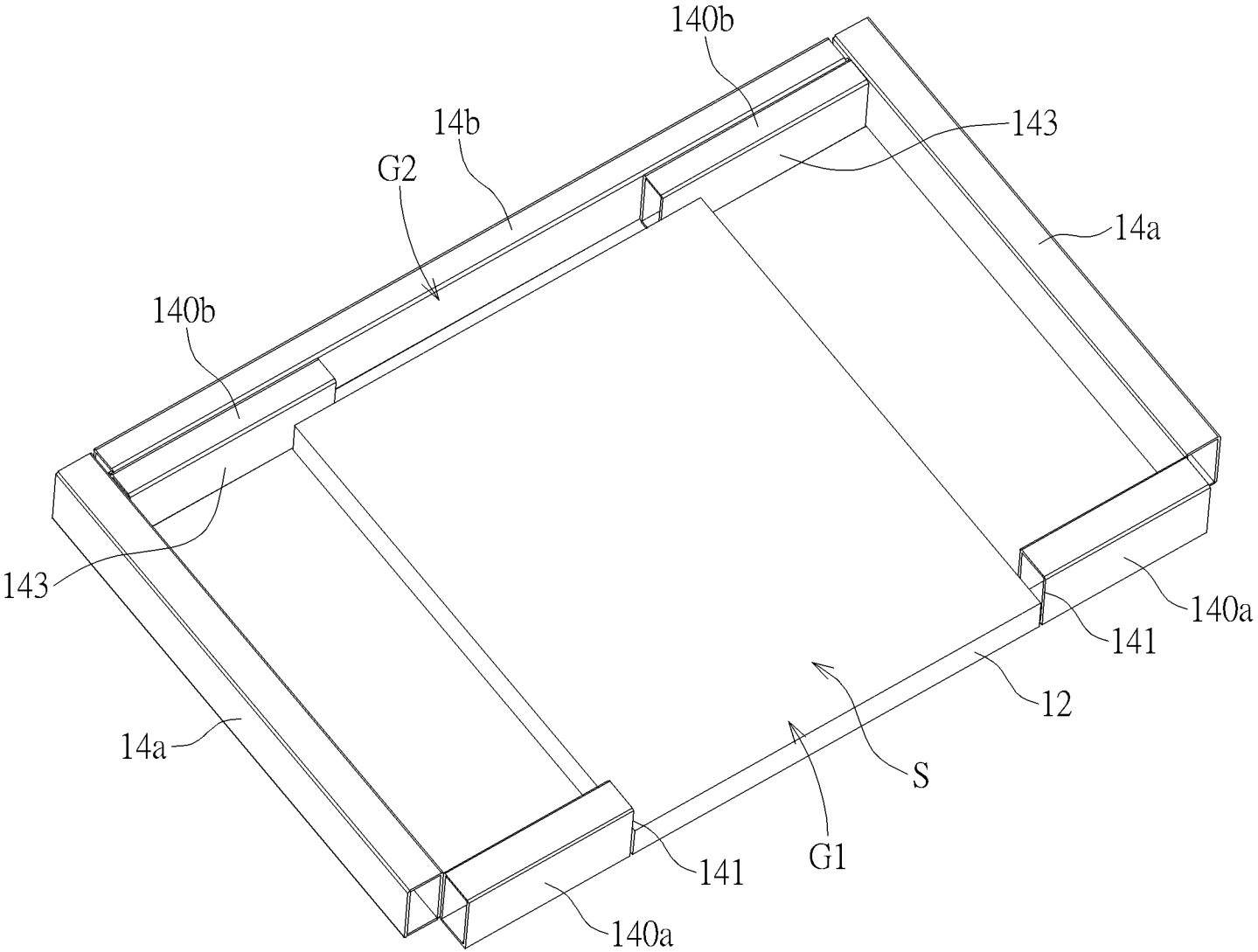
FIG. 15 is a perspective view illustrating the paper tubes and the first cushion member according to another embodiment of the disclosure.

Referring to FIG. 15, FIG. 15 is a perspective view illustrating the paper tubes and the first cushion member 12 according to another embodiment of the disclosure.

As shown in FIG. 15, a number of the paper tubes is three, wherein one of the three paper tubes is strip-shaped and the other two of the three paper tubes are bent to be L-shaped. In other words, the paper tubes comprise two L-shaped paper tubes 14*a* and a strip-shaped paper tube 14*b*. Each of the two L-shaped paper tubes 14*a* may be formed by bending a strip-shaped paper tube along a slot (like the slot 144 shown in FIG. 7) by 90 degrees. The two L-shaped paper tubes 14*a* are disposed at opposite sides of the strip-shaped paper tube 14*b* and located at opposite sides of the box body 10 shown in FIG. 12, wherein opposite ends of the strip-shaped paper tube 14*b* respectively abut against the two L-shaped paper tubes 14*a*. A first gap G1 is formed between two sides 140*a* of the two L-shaped paper tubes 14*a* and opposite to the strip-shaped paper tube 14*b*. Furthermore, two opposite ends 140*b* of the strip-shaped paper tube 14*b* are bent to form two paper tube units stacked with each other, such that a second gap G2 is formed between the two opposite ends 140*b* of the strip-shaped paper tube 14*b*. As shown in FIG. 15, an edge (e.g. lower edge) of the first cushion member 12 is located in the first gap G1 and sandwiched in between the two sides 140*a* of the two L-shaped paper tubes 14*a*, such that an end portion 141 of each of the two L-shaped paper tubes 14*a* is in contact with the first cushion member 12. Furthermore, another edge (e.g. upper edge) of the first cushion member 12 abuts against the two opposite ends 140*b* of the strip-shaped paper tube 14*b*, such that two side portions 143 of the strip-shaped paper tube 14*b* is in contact with the first cushion member 12. Accordingly, the first cushion member 12 can be positioned in the box body 10 stably. The second gap G2 may be configured to accommodate a protruding structure (e.g. function key, etc.) and/or accessories of an electronic product.

Furthermore, the two L-shaped paper tubes 14*a* and the two opposite ends 140*b* of the strip-shaped paper tube 14*b* define an inner space S for accommodating the first cushion member 12.

Figure 16:
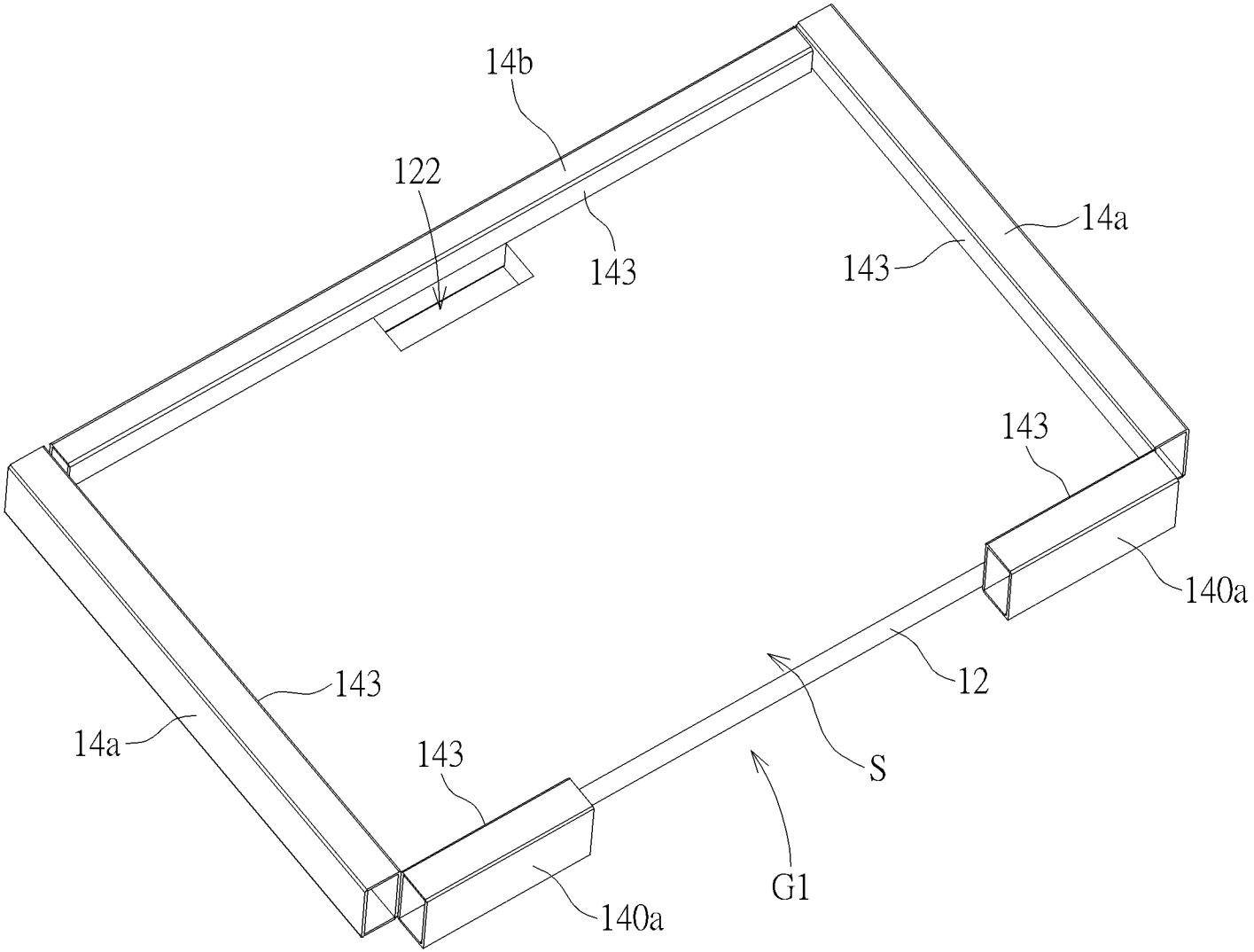
FIG. 16 is a perspective view illustrating the paper tubes and the first cushion member according to another embodiment of the disclosure.

Referring to FIG. 16, FIG. 16 is a perspective view illustrating the paper tubes and the first cushion member 12 according to another embodiment of the disclosure.

As shown in FIG. 16, a number of the paper tubes is three, wherein one of the three paper tubes is strip-shaped and the other two of the three paper tubes are bent to be L-shaped. In other words, the paper tubes comprise two L-shaped paper tubes 14*a* and a strip-shaped paper tube 14*b*. Each of the two L-shaped paper tubes 14*a* may be formed by bending a strip-shaped paper tube along a slot (like the slot 144 shown in FIG. 7) by 90 degrees. The two L-shaped paper tubes 14*a* are disposed at opposite sides of the strip-shaped paper tube 14*b* and located at opposite sides of the box body 10 shown in FIG. 12, wherein opposite ends of the strip-shaped paper tube 14*b* respectively abut against the two L-shaped paper tubes 14*a*. A first gap G1 is formed between two sides 140*a* of the two L-shaped paper tubes 14*a* and opposite to the strip-shaped paper tube 14*b*. As shown in FIG. 16, an edge (e.g. lower edge) of the first cushion member 12 abuts against the two sides 140*a* of the two L-shaped paper tubes 14*a*, such that two side portions 143 of each of the two L-shaped paper tubes 14*a* are in contact with the first cushion member 12. Furthermore, and another edge (e.g. upper edge) of the first cushion member 12 has at least one recess 122 and abuts against the strip-shaped paper tube 14*b*, such that a side portions 143 of the strip-shaped paper tube 14*b* is in contact with the first cushion member 12. The recess 122 and the first gap G1 may be configured to accommodate a protruding structure (e.g. function key, etc.) and/or accessories of an electronic product.

Furthermore, the two L-shaped paper tubes 14*a* and the two opposite ends 140*b* of the strip-shaped paper tube 14*b* define an inner space S for accommodating the first cushion member 12.

Figure 17:
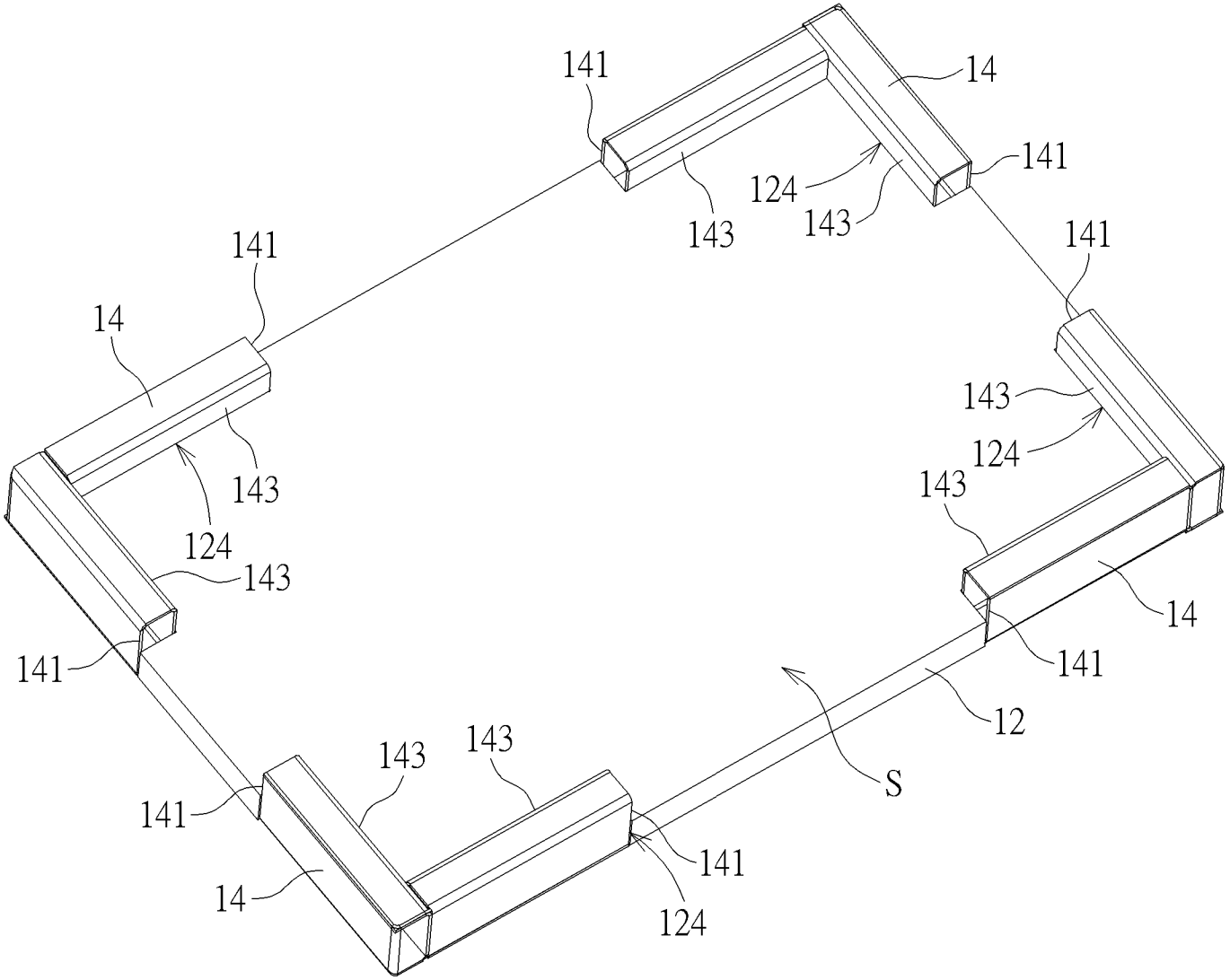
FIG. 17 is a perspective view illustrating the paper tubes and the first cushion member according to another embodiment of the disclosure.

Referring to FIG. 17, FIG. 17 is a perspective view illustrating the paper tubes and the first cushion member 12 according to another embodiment of the disclosure.

As shown in FIG. 17, a number of the paper tubes is four, wherein the four paper tubes 14 are bent to be L-shaped. Each of the four L-shaped paper tubes 14 may be formed by bending a strip-shaped paper tube along a slot (like the slot 144 shown in FIG. 7) by 90 degrees. The four L-shaped paper tubes 14 may be disposed at four corners of the box body 10 shown in FIG. 12. Furthermore, four corners of the first cushion member 12 may have four L-shaped recesses 124, and the four L-shaped paper tubes 14 may be accommodated in the four L-shaped recesses 124, such that two end portions 141 and two side portions 143 of each of the four L-shaped paper tubes 14 are in contact with the first cushion member 12. Accordingly, the first cushion member 12 can be positioned in the box body 10 stably.

Furthermore, the four L-shaped paper tubes 14 define an inner space S for accommodating the first cushion member 12.

Figure 18:
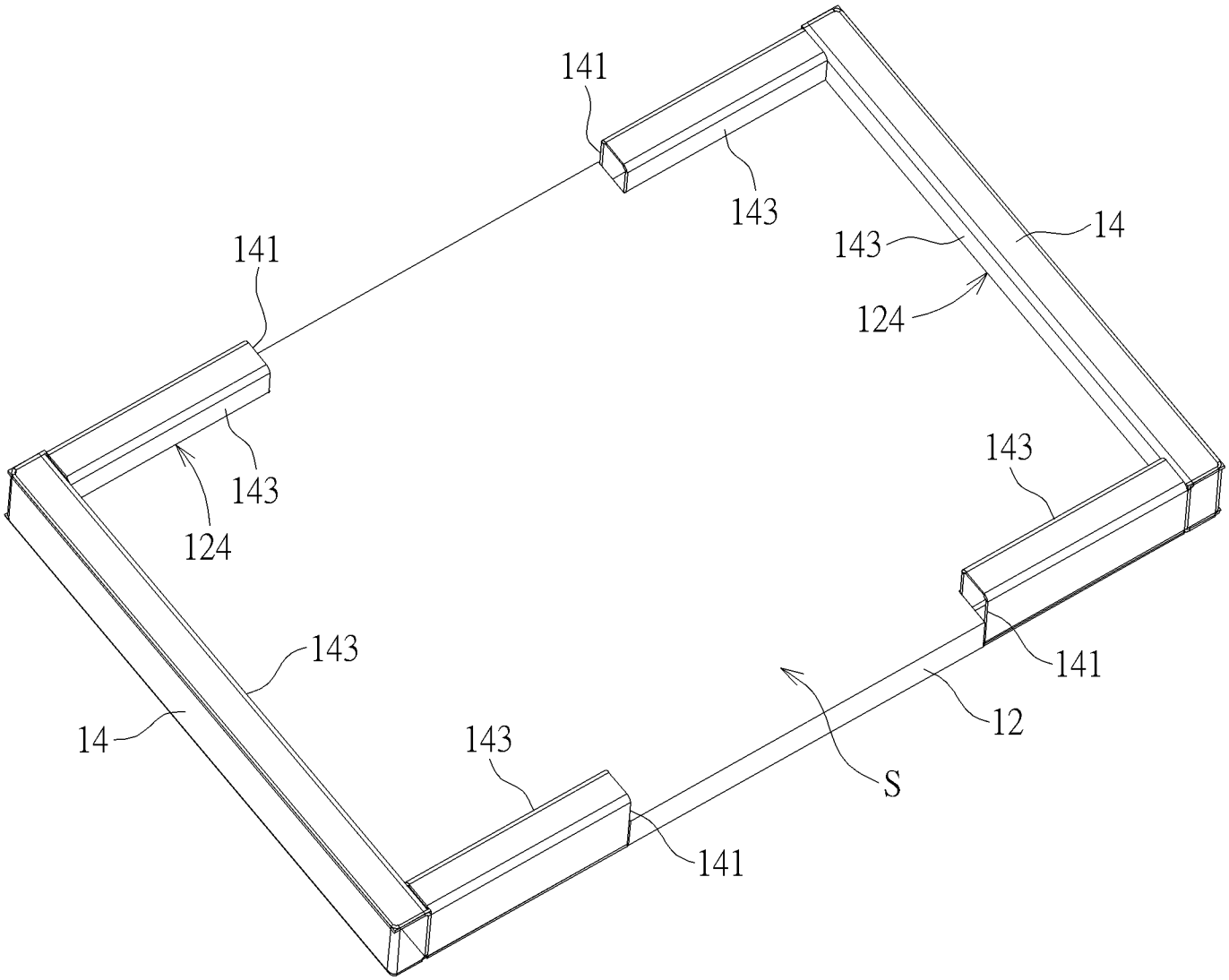
FIG. 18 is a perspective view illustrating the paper tubes and the first cushion member according to another embodiment of the disclosure.

Referring to FIG. 18, FIG. 18 is a perspective view illustrating the paper tubes and the first cushion member 12 according to another embodiment of the disclosure.

As shown in FIG. 18, a number of the paper tubes is two, wherein the two paper tubes 14 are bent to be U-shaped. Each of the two U-shaped paper tubes 14 may be formed by bending two opposite ends of a strip-shaped paper tube along a slot (like the slot 144 shown in FIG. 7) by 90 degrees. The two U-shaped paper tubes 14 may be disposed at two opposite sides of the box body 10 shown in FIG. 12. Furthermore, two opposite sides of the first cushion member 12 may have two U-shaped recesses 124, and the two U-shaped paper tubes 14 may be accommodated in the two U-shaped recesses 124, such that two end portions 141 and three side portions 143 of each of the two U-shaped paper tubes 14 are in contact with the first cushion member 12. Accordingly, the first cushion member 12 can be positioned in the box body 10 stably.

Furthermore, the two U-shaped paper tubes 14 define an inner space S for accommodating the first cushion member 12.

According to the aforesaid embodiments, a side portion of at least one of the paper tubes may be in contact with the first cushion member and/or an end portion of at least one of the paper tubes may be in contact with the first cushion member. Furthermore, according to the aforesaid embodiments, the number of the paper tubes may be two to four. Moreover, according to the aforesaid embodiments, the shape and area of the first cushion member may be designed according to the type and arrangement of the paper tubes.

Figure 19:
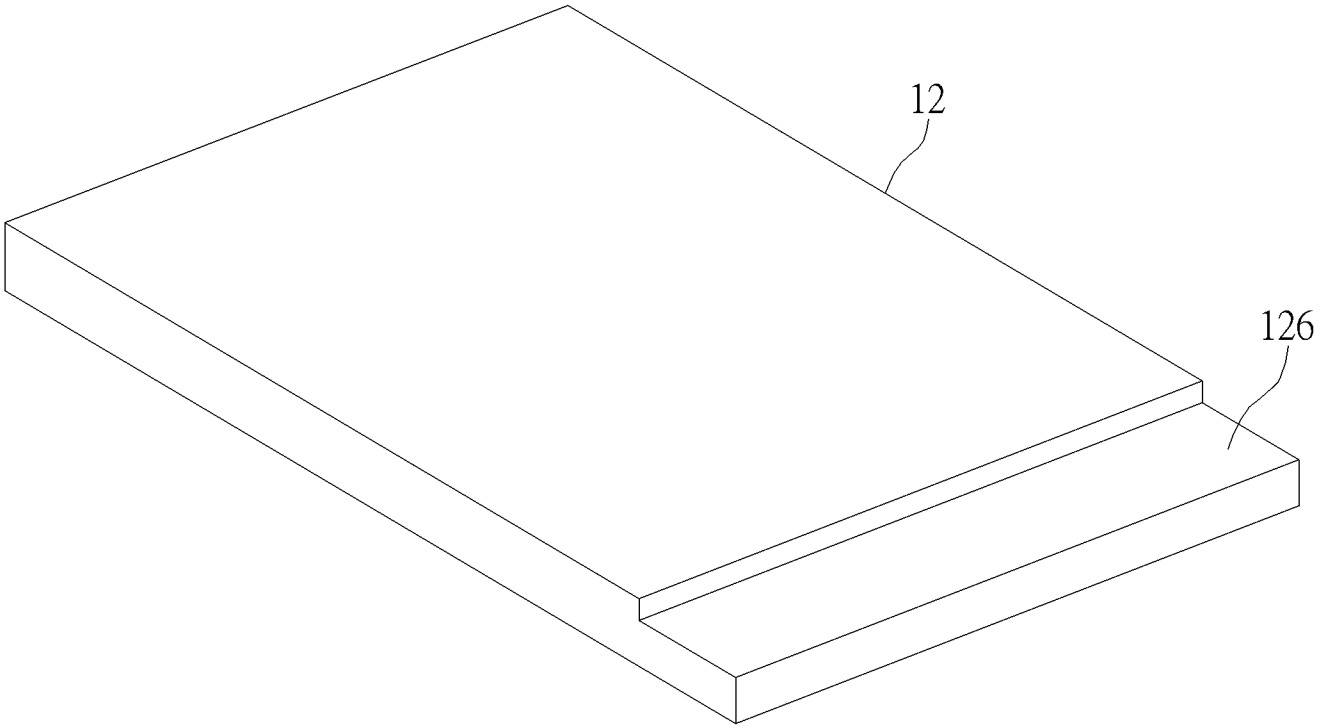
FIG. 19 is a perspective view illustrating the first cushion member according to another embodiment of the disclosure.

Referring to FIG. 19, FIG. 19 is a perspective view illustrating the first cushion member 12 according to another embodiment of the disclosure.

As shown in FIG. 19, the first cushion member 12 may have at least one depression portion 126, wherein the at least one depression portion 126 is a lower plane formed on at least one edge of the first cushion member 12. In this embodiment, the first cushion member 12 may have one depression portion 126 formed at one edge of the first cushion member 12. The depression portion 126 may be configured to accommodate a protruding structure (e.g. function key, etc.) and/or accessories of an electronic product. It should be noted that the depression portion 126 may be formed on all of the first cushion members 12 mentioned in the aforesaid embodiments and the number and position of the depression positions 126 may be determined according to practical applications.

In another embodiment of the disclosure, the aforesaid first cushion member 12 may have at least one recess or opening for accommodating a protruding structure (e.g. function key, etc.) and/or accessories of an electronic product.

In another embodiment of the disclosure, the aforesaid paper tube 14 may have at least one recess or opening for accommodating a protruding structure (e.g. function key, etc.) and/or accessories of an electronic product.

As mentioned in the above, the disclosure replaces the molded pulp and/or the corrugated paper of the prior art by the first cushion member with the porous structure and the paper tube, so as to reduce assembly materials of the cushion package box, reduce assembly cost, and improve assembly efficiency. Since the structure of the cushion package box is simplified, the disclosure can effectively avoid the problems such as improper assembly and lack of components due to manual assembly operation. Furthermore, the cushion abilities of the first cushion member with the porous structure and the paper tube are good, such that the disclosure can effectively improve the protection to the product. Moreover, the material characteristics of the first cushion member with the porous structure and the paper tube may reduce the cushion distance, such that the whole volume of the cushion package box may be further reduced, so as to increase the packing capacity of the cushion package box and reduce the transportation cost. In practical applications, the cushion package box of the disclosure may be used to pack an object (e.g. electronic product) to form the electronic product cushion package assembly. In addition, the number and shape of the paper tubes and the size of the first cushion member may be determined according to the type of the object. Accordingly, the cushion package box may be more flexible in design and use.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A cushion package box comprising:

a box body;

a first cushion member disposed in the box body, the first cushion member having a porous structure; and a plurality of paper tubes disposed in the box body, at least one of the plurality of paper tubes being in contact with the first cushion member, an opening direction of the porous structure being different from an opening direction of the plurality of paper tubes.

2. The cushion package box of claim 1, wherein a side portion of the at least one of the plurality of paper tubes is in contact with the first cushion member.

3. The cushion package box of claim 1, wherein an end portion of the at least one of the plurality of paper tubes is in contact with the first cushion member.

4. The cushion package box of claim 1, wherein a side portion of the at least one of the plurality of paper tubes is in contact with the first cushion member, and an end portion of at least another one of the plurality of paper tubes is in contact with the first cushion member.

5. The cushion package box of claim 1, wherein the first cushion member having at least one depression portion, the at least one depression portion being formed on at least one edge of the first cushion member.

6. The cushion package box of claim 1, wherein a number of the plurality of paper tubes is three, one of the three paper tubes is strip-shaped, the other two of the three paper tubes are bent to be L-shaped, the two L-shaped paper tubes are disposed at opposite sides of the strip-shaped paper tube, and a first gap is formed between two sides of the two L-shaped paper tubes.

7. The cushion package box of claim 6, wherein an edge of the first cushion member is located in the first gap and sandwiched in between the two sides of the two L-shaped paper tubes, and another edge of the first cushion member abuts against the strip-shaped paper tube.

8. The cushion package box of claim 6, wherein two opposite ends of the strip-shaped paper tube are bent to form two paper tube units stacked with each other, a second gap is formed between the two opposite ends of the strip-shaped paper tube, an edge of the first cushion member is located in the first gap and sandwiched in between the two sides of the two L-shaped paper tubes, and another edge of the first cushion member abuts against the strip-shaped paper tube.

9. The cushion package box of claim 6, wherein an edge of the first cushion member abuts against the two sides of the two L-shaped paper tubes, and another edge of the first cushion member has at least one recess and abuts against the strip-shaped paper tube.

10. The cushion package box of claim 1, wherein a number of the plurality of paper tubes is four, the four paper tubes are bent to be L-shaped and disposed at four corners of the box body, four corners of the first cushion member has four L-shaped recesses, and the four L-shaped paper tubes are accommodated in the four L-shaped recesses.

11. The cushion package box of claim 1, wherein a number of the plurality of paper tubes is two, the two paper tubes are bent to be U-shaped and disposed at two opposite sides of the box body, two opposite sides of the first cushion member has two U-shaped recesses, and the two U-shaped paper tubes are accommodated in the two U-shaped recesses.

12. The cushion package box of claim 1, wherein the plurality of paper tubes comprises two L-shaped paper tubes and two double-stacked paper tubes, the two L-shaped paper tubes are located at opposite sides of the box body, the two double-stacked paper tubes respectively abut against the two L-shaped paper tubes, a first gap is formed between two sides of the two L-shaped paper tubes, a second gap is formed between the two double-stacked paper tubes, an edge of the first cushion member is located in the first gap and sandwiched in between the two sides of the two L-shaped paper tubes, and another edge of the first cushion member is located in the second gap and sandwiched in between the two double-stacked paper tubes.

13. The cushion package box of claim 1, wherein each of the plurality of paper tubes is in contact with the first cushion member.

14. The cushion package box of claim 1, wherein the opening direction of the porous structure is perpendicular to the opening direction of the plurality of paper tubes.

15. The cushion package box of claim 1, further comprising a second cushion member disposed in the box body and located above the first cushion member.

16. The cushion package box of claim 1, wherein a tube body of the plurality of paper tubes has two cutting grooves and a reinforcing portion, the reinforcing portion is located between the two cutting grooves, and the reinforcing portion is located in the tube body when the tube body is bent.

17. The cushion package box of claim 1, wherein a tube body of the plurality of paper tubes has a slot, such that the plurality of paper tubes is able to be bent along the slot by 90 or 180 degrees.

18. The cushion package box of claim 1, wherein at least one reinforcing portion is bent from a side of the plurality of paper tubes to abut against an inner surface of the plurality of paper tubes.

19. The cushion package box of claim 1, wherein the plurality of paper tubes defines an inner space for accommodating the first cushion member.

20. An electronic product cushion package assembly comprising:

a cushion package box comprising a box body, a first cushion member and a plurality of paper tubes, the first cushion member being disposed in the box body, the first cushion member having a porous structure, the plurality of paper tubes being disposed in the box body, at least one of the plurality of paper tubes being in contact with the first cushion member, an opening direction of the porous structure being different from an opening direction of the plurality of paper tubes; and an electronic product disposed in the box body, the plurality of paper tubes surrounding the electronic product.

* * * * *